United States Patent [19]

Marsh

[11] 4,253,822

[45] Mar. 3, 1981

[54] DRYING WOOD PULP

[75] Inventor: Geoffrey D. Marsh, Coventry, England

[73] Assignee: Courtaulds Limited, London, England

[21] Appl. No.: 946,728

[22] Filed: Sep. 28, 1978

[30] Foreign Application Priority Data

Oct. 6, 1977 [GB] United Kingdom ..... 41596/77

[51] Int. Cl.[3] ..... F27B 5/00; F26B 7/00

[52] U.S. Cl. ..... 432/14; 34/13.8; 34/9.5

[58] Field of Search ..... 34/9.5, 13.8, 16.5, 34/35, 219, 181; 432/14, 72; 162/23, 100

[56] References Cited

U.S. PATENT DOCUMENTS

| | | | |
|---|---|---|---|
| 3,069,784 | 12/1962 | Aldred et al. | 34/13.8 |
| 3,256,614 | 6/1966 | Dunbar | 162/100 |
| 3,604,824 | 9/1971 | Haridson | 432/72 |
| 3,808,090 | 4/1974 | Logan et al. | 162/23 |
| 4,059,395 | 11/1977 | Strunz et al. | 432/72 |

*Primary Examiner*—Henry C. Yuen

*Attorney, Agent, or Firm*—Davis, Hoxie, Faithfull & Hapgood

[57] ABSTRACT

Wood pulp is dried by contacting it with heated air and subjecting the air and pulp to turbulence in a dryer comprising relatively contrarotating members which intermesh on rotation so that dried wood pulp fibres are suspended in the air issuing from the dryer. The heated air is produced by heating air in a burner to a temperature of from 300° to 600° C. by burning a fuel in the air.

The dried wood pulp fibres are separated from the air and a portion of the air thus separated is recycled to the burner. The air admitted to the burner comprises fresh air and recycled air, the proportion of fresh air being such that the heated air contacting the pulp has an oxygen content of less than 10 percent by volume. The use of recycled air reduces the risk of fire when drying the wood pulp.

4 Claims, 1 Drawing Figure

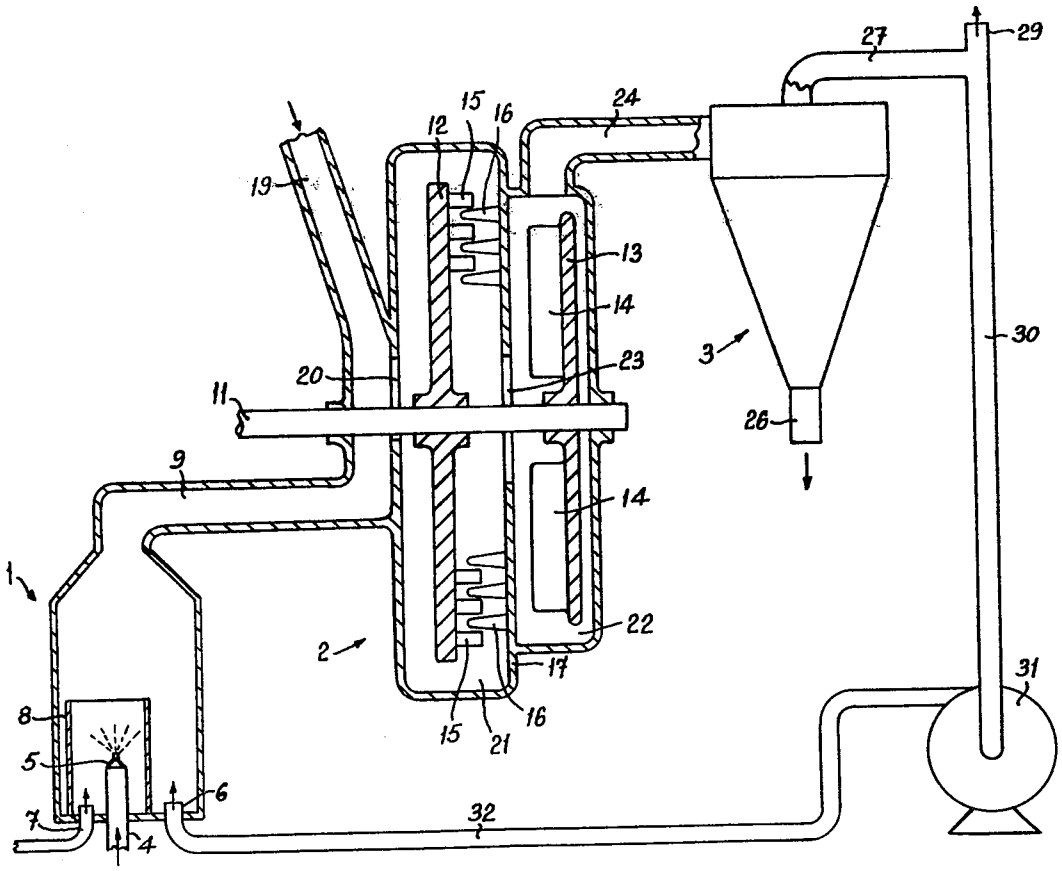
29
27
24
19
12
15
16
13
14
23
20
11
9
1
8
5
7
4
6
2
32
21
15
16
17
22
14
3
26
30
31

DRYING WOOD PULP

This invention relates to a process for drying wood pulp.

British Patent specification No. 888,845 describes and claims a process for drying wood pulp in which the wood pulp is brought into contact with air which is at a temperature of from 300° to 550° C. and the air and pulp are subjected to turbulence until the air is at a temperature of from 90° to 120° C. The turbulence is produced in a dryer comprising relatively contrarotating members which intermesh on rotation. The dryer also acts to break up agglomerated bundles of wood fibres in the pulp.

The process described in specification No. 888,845 has the potential disadvantage that pulp delayed in the dryer can overheat and start a fire in the dryer. The process of specification No. 888,845 has most frequently been used to dry pulp produced by a chemical pulping process. There have been fires when drying this pulp and the risk of fire is likely to be greater in the drying of pulp produced by a thermomechanical pulping process as described in Malpiedi et al U.S. Patent Application No. 912,716 filed on June 5th, 1978 now abandoned.

The present invention aims to reduce the risk of fire when wood pulp is dried by this process.

According to the invention a process for drying wood pulp comprises:

(i) heating air in a burner to a temperature of from 300° to 600° C. by burning a fuel in the air, (ii) contacting the heated air with the wood pulp and subjecting the air and pulp to turbulence in a dryer comprising relatively contrarotating members which intermesh on rotation so that dried wood pulp fibres are suspended in the air issuing from the dryer, (iii) separating the dried wood pulp fibres from the air, and (iv) recycling a portion of the air thus separated to the burner, the air admitted to the burner comprising fresh air and recycled air, the proportion of fresh air being such that the heated air contacting the pulp has an oxygen content of less than 10 percent by volume.

The fuel used in the burner is preferably oil, or gas. Some oxygen in the air is consumed in burning the fuel so that the oxygen content of the air passing from the burner to contact the pulp is lowered. As this air is recycled to the burner, its oxygen content is progressively lowered to a steady equilibrium value.

When starting up the process according to the invention it may be preferred to recycle heated air to the burner until the oxygen content is at the desired level of less than 10 percent by volume before contacting it with the wood pulp. The preferred oxygen content of the air measured as it contacts the pulp is from 3 to 8 percent by volume which prevents burning of the pulp in the dryer.

The turbulence produced in the dryer is preferably such that the temperature of the stream of heated air falls to a value of from 100° to 150° C. within one second of contacting the pulp. Such a dryer disperses the wood pulp fibres substantially evenly in the air so that a suspension of dry wood pulp fibres in air issues from the dryer.

The wood pulp before drying preferably contains from 40 to 75 percent by weight of water based on the weight of wet pulp. The wood pulp can be pulp produced by a chemical, mechanical of thermomechanical pulping process. Usually the wood is pulped at a lower consistency and then pressed to remove some moisture, although pulp produced by a thermomechanical pulping process in a double disc refiner may be fed direct to the dryer.

The dry wood pulp fibres can be separated from their suspension in air in conventional apparatus, for example, a cyclone separator. The air issuing from the cyclone separator is split into two streams. One is recycled to the burner and the other is vented to the atmosphere, optionally after extracting heat from it. The proportion of air recycled is usually from 55 to 75 percent when the drying system is operated to keep a steady level of oxygen in the air contacting the pulp.

Care should be taken that the air contacting the fuel at the burner has a high enough oxygen content to support combustion. Fresh air is preferably admitted separately to the burner so that the air first contacted by the fuel is substantially all fresh air, in which the fuel burns. The fresh air preferably comprises from 14 to 25 percent of the total air entering the burner.

The recycled air contains moisture extracted from the wood pulp. Surprisingly this can be advantageous in the drying process. The water vapour has a higher specific heat per unit volume than air; this means that less moist air is needed in proportion to wood pulp than would be needed if dry air at the same temperature was used. Thus, a higher throughput of wood pulp can be achieved, for example, up to 25 percent higher throughput if the moisture content of the heated air contacting the pulp is 50 percent by volume. Moreover, the moisture in the air further reduces the risk of fire. The moisture content of the heated air contacting the pulp is preferably more than 30 percent by volume. If the moisture content of the air is less than 30 percent by volume, the risk of fire is reduced at oxygen concentrations of from 8 to 10 percent by volume in the heated air contacting the pulp, but is not substantially eliminated unless the oxygen concentration is less than 8 percent by volume. If the moisture content of the heated air contacting the pulp is greater than 30 percent by volume, the risk of fire is substantially eliminated at all oxygen concentrations below 10 percent by volume.

The invention will now be described, by way of example, with reference to the accompanying drawing, the single FIGURE of which is a diagrammatic side elevation, partly in section, of an apparatus for drying wood pulp by the process according to the invention.

The apparatus shown comprises generally a burner 1, a high turbulence dryer 2 and a cyclone separator 3.

The burner 1 has a fuel inlet 4 terminating in a jet 5, an inlet 6 for recycled air and an inlet 7 for fresh air. The jet 5 and the fresh air inlet 7 open inside an inner housing 8 so that the air contacted by the fuel at jet 5 is substantially all fresh air. The outlet 9 of the burner leads to the dryer 2.

The dryer 2, comprises a shaft 11 which carries a rotor 12 and a fan 13, the latter having radial vanes 14. The rotor 12 carries teeth 15 disposed in concentric circles on one of its faces. A further series of teeth 16 projects from the housing 17 of the dryer 2 in concentric circles located between the circles of teeth 15.

The burner outlet 19 joins a pulp inlet passage 19 before passing through an inlet aperture 20 into the interior of the housing 17 of the dryer 2. Communication between the rotor chamber 21 and the fan chamber 22 is provided by an aperture 23. Egress from the fan chamber 22 is via an exit passage 24 leading to the cyclone separator 3.

The cyclone separator 3 is of conventional design and has an outlet 26 for the dried wood pulp product and an outlet pipe 27 for the air separated from it. The outlet pipe 27 joins two pipes 29, 30, the pipe 29 being vented to the atmosphere. The pipe 30 leads to the intake of a fan 31 which recycles a proportion of the air issuing from the outlet pipe 27 to the inlet 6 of burner 1 via a pipe 32.

The process according to the invention is illustrated by the following non-limitative Examples:

EXAMPLE 1

Using apparatus similar to that shown in the drawing, the burner 1 was controlled so that 96.6 cubic meters per minute of air at 450° C. passes through the outlet 9. Wood pulp at 50 percent solids was fed to the dryer 2 via the inlet 19 at 890 kg per hour (wet basis). The temperature of the air issuing through the exit passage 24 of dryer 2 was about 120° C.

The air passing along the outlet pipe 27 divided into two streames in the pipes 30 and 29 in a proportion of 2.0:1. The proportion of recycled air and fresh air entering the burner 1 through the inlets 6 and 7 was 5.6:1 by volume. The oxygen content of the air issuing through the outlet 9 of the burner 1 was 4 percent by volume.

Dry fluffy wood pulp was produced without charring or burning.

EXAMPLE 2

In a larger scale experiment using an apparatus similar to that shown in the drawing, wood pulp at 45 percent solids was fed to the dryer at 7600 kg per hour (wet basis). Air at 450° C. passed through the outlet of the burner at 760 $m^3$ per minute. The temperature of the air issuing from the dryer was 120° C.

The air passing along the outlet pipe 27 from the cyclone separator was divided into two streams in the pipes 30 and 29 in a proportion of 1.5:1 respectively. The proportion of recycled air and fresh air entering the burner was 4.6:1 by volume. The oxygen content of the air issuing from the outlet of the burner was 8 percent by volume.

Dry fluffy wood pulp was produced without charring or burning.

EXAMPLE 3

In this Example the tendency of dry pulp to burn in different atmospheres was tested. Similar pieces of dry pulp were placed in the centre of a 2 cm diameter tube, 65 cm long. Air was passed along the tube at 9.44 liters per minute while the tube was heated in a furnace at 475° C. The pulp was observed through the open exit of the tube and glowing or sparking of the pulp was noted. This experiment is a severe test designed to simulate the situation of pulp which unexpectedly sticks in the dryer. The results are shown in the following table:

| Drying air composition (Percentage by volume) | | | |
|---|---|---|---|
| Oxygen | Nitrogen | Moisture | Observation |
| 14 | 86 | NIL | Strong glow |
| 11 | 89 | NIL | Strong glow |
| 10 | 90 | NIL | Strong glow and sparks |
| 9 | 91 | NIL | Weak glow and sparks |
| 7 | 93 | NIL | No visible reaction |
| 5 | 95 | NIL | No visible reaction |
| 14 | 76 | 10 | Strong glow |
| 11 | 78 | 10 | Strong glow |
| 10 | 80 | 10 | Strong glow and sparks |
| 9 | 81 | 10 | Weak glow and sparks |
| 7 | 83 | 10 | No visible reaction |
| 5 | 85 | 10 | No visible reaction |
| 14 | 56 | 30 | Strong glow |
| 11 | 59 | 30 | Weak glow |
| 10 | 60 | 30 | Weak glow and sparks |
| 9 | 61 | 30 | Sparking only |
| 7 | 63 | 30 | No visible reaction |
| 5 | 65 | 30 | No visible reaction |
| 14 | 46 | 40 | Strong glow |
| 11 | 49 | 40 | Weak glow |
| 10 | 50 | 40 | Weak glow and sparks |
| 9 | 51 | 40 | No visible reaction |
| 7 | 53 | 40 | No visible reaction |
| 5 | 55 | 40 | No visible reaction |
| 14 | 36 | 50 | Strong glow |
| 11 | 39 | 50 | Weak glow and sparks |
| 10 | 40 | 50 | Weak glow |
| 9 | 41 | 50 | No visible reaction |
| 7 | 43 | 50 | No visible reaction |
| 5 | 45 | 50 | No visible reaction |

What is claimed is:

1. In a process for drying wood pulp comprising (i) heating air in a burner to a temperature of 300° C. to 600° C. by burning a fuel in the air (ii) contacting the heated air with the wood pulp and subjecting the air and pulp to turbulence in a dryer comprising relatively rotating members which intermesh on rotation so that the dried wood pulp fibres are suspended in the air issuing from the dryer and (iii) separating the dried wood pulp fibres from the air, the improvement comprising recycling 55 to 75 percent by volume of the air thus separated to the burner so that the air admitted to the burner comprises 14 to 25 percent by volume fresh air and 75 to 86 percent by volume recycled air, the proportions of fresh air and recycled air being such that the heated air contacting the pulp has an oxygen content of less than 10 percent by volume and a moisture content of more than 30 percent by volume.

2. A process according to claim 1 in which the heated air contacting the pulp has an oxygen content of from 3 to 8 percent by volume.

3. A process according to claim 1 in which the fresh air is admitted separately to the burner so that the air first contacted by the fuel is predominantly fresh air in which the fuel burns.

4. A process according to claim 1 in which the heated air contacting the pulp has an oxygen content of not more than 9 percent by volume and a moisture content of at least 40 percent by volume.

* * * * *

UNITED STATES PATENT AND TRADEMARK OFFICE

CERTIFICATE OF CORRECTION

PATENT NO. : 4,253,822

DATED : March 3, 1981

INVENTOR(S) : Marsh, Geoffrey D.

It is certified that error appears in the above-identified patent and that said Letters Patent are hereby corrected as shown below:

Column 2, line 67, "outlet 19" should be --outlet 9--.

Signed and Sealed this

*Seventh* Day of *July 1981*

[SEAL]

*Attest:*

RENE D. TEGTMEYER

*Attesting Officer*

*Acting Commissioner of Patents and Trademarks*